US007182222B2

(12) United States Patent
Prabucki

(10) Patent No.: US 7,182,222 B2
(45) Date of Patent: Feb. 27, 2007

(54) SOLAR PANEL AND WATER DISPENSER

(76) Inventor: Robert W. Prabucki, 150 W. Exeter St., Gladstone, OR (US) 97027

( * ) Notice: Subject to any disclaimer, the term of this patent is extended or adjusted under 35 U.S.C. 154(b) by 0 days.

(21) Appl. No.: 11/339,594

(22) Filed: Jan. 24, 2006

(65) Prior Publication Data

US 2006/0124665 A1 Jun. 15, 2006

Related U.S. Application Data

(63) Continuation-in-part of application No. 11/139,220, filed on May 27, 2005.

(60) Provisional application No. 60/575,797, filed on May 29, 2004.

(51) Int. Cl.
*B67D 5/62* (2006.01)

(52) U.S. Cl. ..... 222/146.6; 222/185.1; 222/146.1; 222/175; 222/608; 62/3.64; 62/389

(58) Field of Classification Search .. 222/146.1–146.6, 222/175, 608, 183, 185.1, 131; 62/3.64, 62/389; 165/68, 61; 136/291, 206, 243–265; 236/93

See application file for complete search history.

(56) References Cited

U.S. PATENT DOCUMENTS

| | | | | |
|---|---|---|---|---|
| 4,409,961 | A | 10/1983 | O'Hara | |
| 5,235,822 | A | 8/1993 | Leonovich, Jr. | |
| 5,447,041 | A | 9/1995 | Piechota | |
| 5,501,077 | A * | 3/1996 | Davis et al. | 62/3.64 |
| 5,636,852 | A | 6/1997 | Sistrunk et al. | |
| 5,752,661 | A * | 5/1998 | Lewis | 239/153 |
| 5,866,880 | A | 2/1999 | Seitz et al. | |
| 6,021,642 | A | 2/2000 | Guinn | |
| 6,080,971 | A | 6/2000 | Seitz et al. | |
| 6,193,894 | B1 | 2/2001 | Hollander | |
| 6,305,185 | B1 | 10/2001 | Sloan | |
| 6,354,511 | B1 | 3/2002 | Hardee | |
| 6,457,317 | B1 * | 10/2002 | O'Donnell | 62/60 |
| 6,547,317 | B1 * | 4/2003 | Cheron et al. | 296/193.01 |
| 6,751,963 | B2 | 6/2004 | Navedo et al. | |
| 6,931,756 | B2 | 8/2005 | Morgan et al. | |
| 6,980,788 | B2 | 12/2005 | Peeples | |
| 2002/0134091 | A1 | 9/2002 | Molfese | |
| 2003/0076672 | A1 | 4/2003 | Head | |
| 2003/0136797 | A1 | 7/2003 | Thomason | |
| 2003/0157893 | A1 | 8/2003 | Peeples | |

(Continued)

*Primary Examiner*—Kevin Shaver
*Assistant Examiner*—Stephanie E. Tyler
(74) *Attorney, Agent, or Firm*—J. Douglas Wells; Chernoff, Vilhauer, McClung & Stenzel, LLP

(57) ABSTRACT

A beverage cooler is provided having a container for holding a liquid beverage, a spigot extending from the container for dispensing the liquid beverage therefrom, preferably a telescopically extendable boom attached to a side of the container, a solar panel adjustably attached to an end of the telescopically extendable boom so that the solar panel may be repositioned about the end of the telescopically extendable boom so as to point the solar panel in a direction toward a source of solar energy, and one or more active elements in thermal contact with the container and the liquid beverage therein and electrically connected to the solar panel. Thermoelectric elements powered by the solar panel may be used to cool or heat the liquid beverage within the container.

10 Claims, 12 Drawing Sheets

U.S. PATENT DOCUMENTS

| | | | |
|---|---|---|---|
| 2003/0213755 | A1 | 11/2003 | Hanbli |
| 2004/0055313 | A1 | 3/2004 | Navedo et al. |
| 2005/0076665 | A1 | 4/2005 | Pruitt |
| 2005/0133082 | A1 | 6/2005 | Konold et al. |
| 2005/0139552 | A1 | 6/2005 | Forsberg et al. |
| 2005/0160620 | A1 | 7/2005 | Morgan et al. |
| 2005/0233189 | A1 | 10/2005 | Shioya |
| 2005/0257827 | A1 | 11/2005 | Gaudiana et al. |
| 2005/0268962 | A1 | 12/2005 | Gaudiana et al. |
| 2005/0284151 | A1 | 12/2005 | Xing |
| 2005/0284167 | A1 | 12/2005 | Morgan et al. |
| 2006/0003216 | A1 | 1/2006 | Tanaka et al. |

* cited by examiner

SOLAR PANEL AND WATER DISPENSER

CROSS-REFERENCE TO RELATED APPLICATIONS

This application is a continuation-in-part of U.S. application Ser. No. 11/139,220, filed May 27, 2005, which has the title "Portable Bottled Water Dispenser" and claims the benefit of U.S. provisional application Ser. No. 60/575,797, filed May 29, 2004. The specifications of the above applications are incorporated herein by reference.

BACKGROUND OF THE INVENTION

The technical field of invention relates to solar panel and dispenser devices associated with dispensing liquid beverages. More particularly, the present invention pertains to solar panel and water dispenser devices associated with dispensing drinking water or dispensing drinking water from standard sized bottled drinking water.

The design of most commonly available water dispensers includes a receiving device for gravitationally a holding three- or five-gallon bottle of drinking water, a small reservoir through which the drinking water passes and in which the water is either heated or chilled by active components (heating and/or cooling coils), a spigot for dispensing the water, and a vertical cabinet containing the aforementioned components plus associated compressors and related components. Most of the dispensers currently available are floor models, although tabletop or countertop units have recently been produced.

All of these prior designed water dispensers are suitable only for stationary or static location applications and are not suitable for truly portable use. None of the currently available dispensers can be transported as one would transport a typical cylindrical style cooler/container, and none are suitably configured or appropriately integrated into the design of vehicle utility compartments or toolboxes such as the toolboxes currently available for use with pickup trucks.

Instead of using bottled water dispensers, contractors, road construction crews, and others routinely needing a source of drinking water at a job site are currently using the cylindrical type coolers/containers strapped to their truck utility box or simply thrown in the back of such vehicles used at job sites. The water dispensed by such containers is typically not cooled except for perhaps an initial quantity of ice that is mixed into the water to be dispensed or additional ice periodically added to the water to be dispensed.

Consequently, the water to be dispensed by such containers is typically mixed in with the cooling ice and easily becomes tainted by any flavors or impurities contained in the ice. The water may become contaminated by dirty ice, handled ice, and so forth. Further, the container may become contaminated over time since water is typically added to such containers using available water supplies, commonly a garden hose or available bucket, which may themselves be contaminated.

In addition to frequently unsanitary methods of refilling these water coolers/containers (at job sites), a substantial number of coolers used at job sites are simply not cleaned in a manner or frequency capable of ensuring a reasonable level of sanitation. More often than not, job site coolers that have become fouled are simply rinsed out with water and refilled with water from a garden hose or bucket. As a result, these job site water containers remain unsanitary and provide convenient breeding grounds for harmful bacteria, viruses, and diseases.

The health hazards of unsanitary drinking water are apparent. At job sites, productivity may be adversely affected by workers sickened or made ill due to unsanitary drinking water. Job site foremen have complained of workers becoming sick during the work day potentially due to unsanitary drinking water, a lack of available clean drinking water, and so on. Job site workers have expressed a need for clean drinking water at job sites and for water that is cooled or heated depending upon the conditions at the job sites and the desires of job site personnel.

What is needed, therefore, is a different style of water dispenser. What is needed is an improved drinking water dispenser with improved sanitation and means for cooling or heating the drinking water or liquid beverage to be dispensed.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

For a more complete understanding of the present invention, the drawings herein illustrate examples of the invention. The drawings, however, do not limit the scope of the invention. Similar references in the drawings indicate similar elements.

Figure 8A:
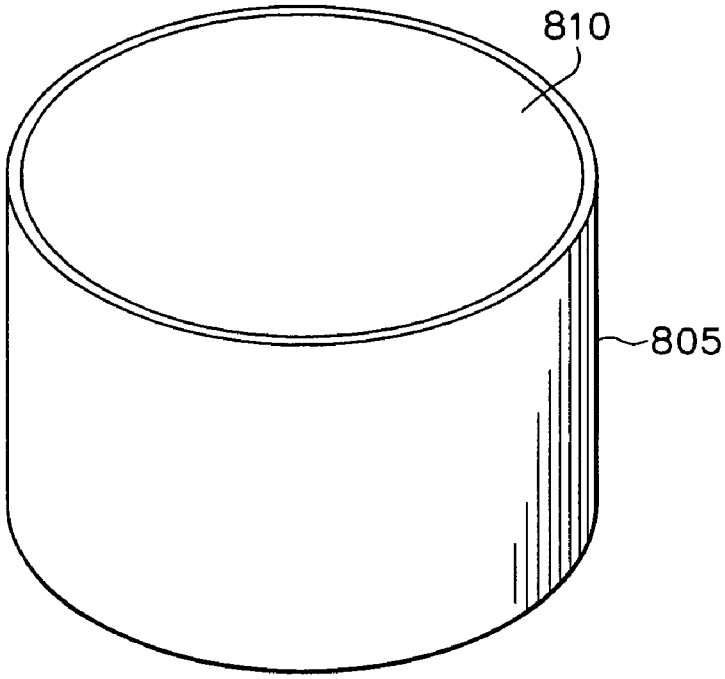
Figure 8B:
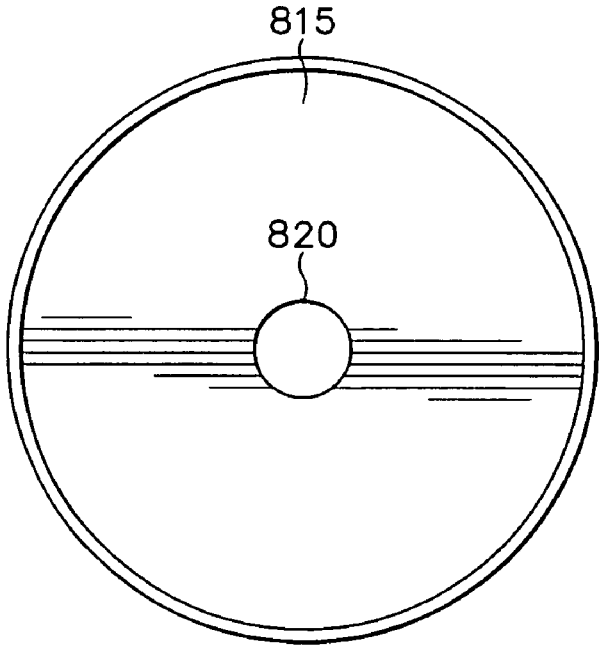

FIGS. 8*a* and 8*b* illustrate an exemplary reservoir for use with a portable bottled water dispenser according to one embodiment of the invention.

Figure 9:
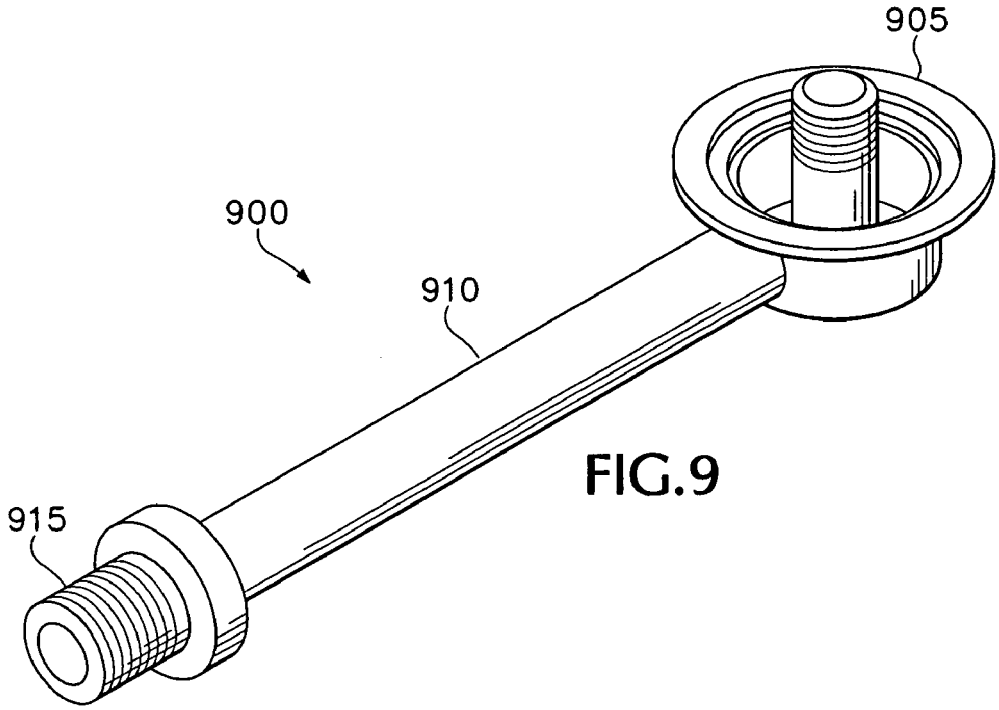

FIG. 9 illustrates an exemplary drain tube for use with a portable bottled water dispenser according to one embodiment of the invention.

Figure 10:
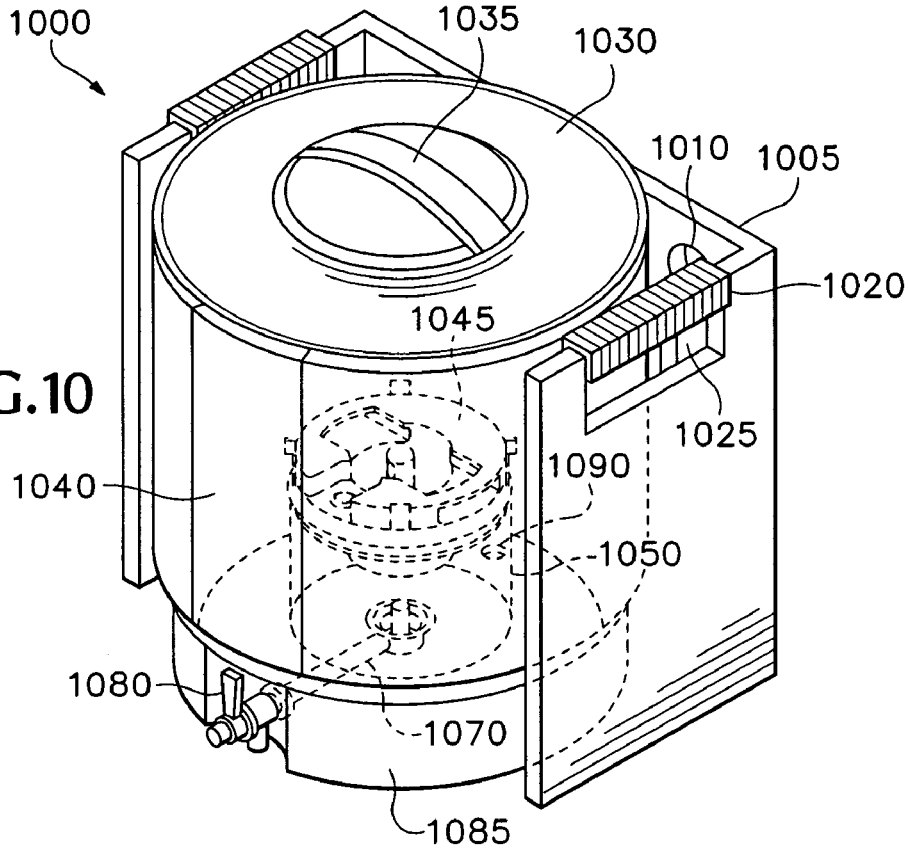

FIG. 10 illustrates an isometric transparent view of a portable bottled water dispenser with carrying frame, according to one embodiment of the invention.

Figure 11:
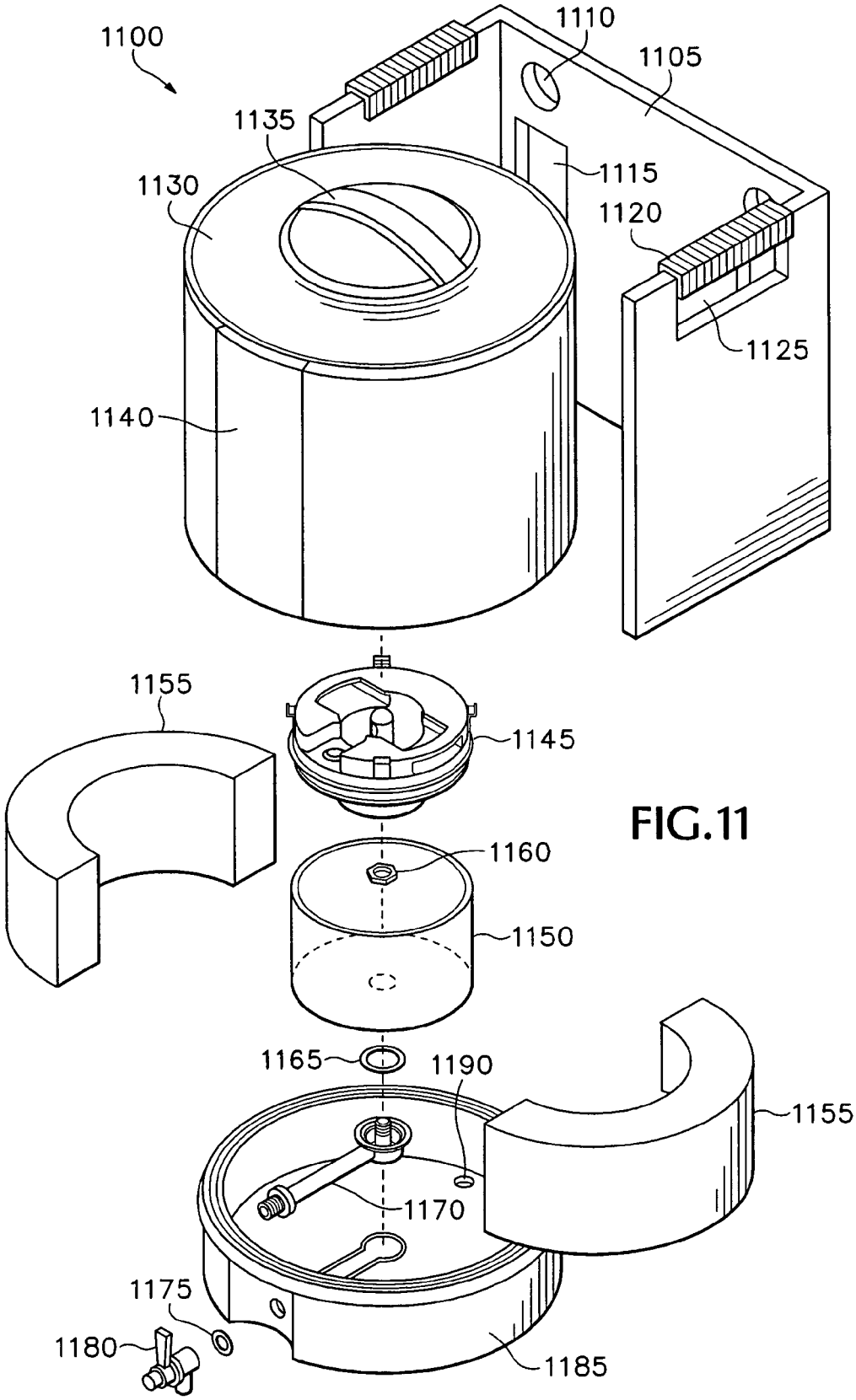

FIG. 11 illustrates an exploded view of the portable bottled water dispenser with shoulder straps shown in FIG. 10.

Figure 12:
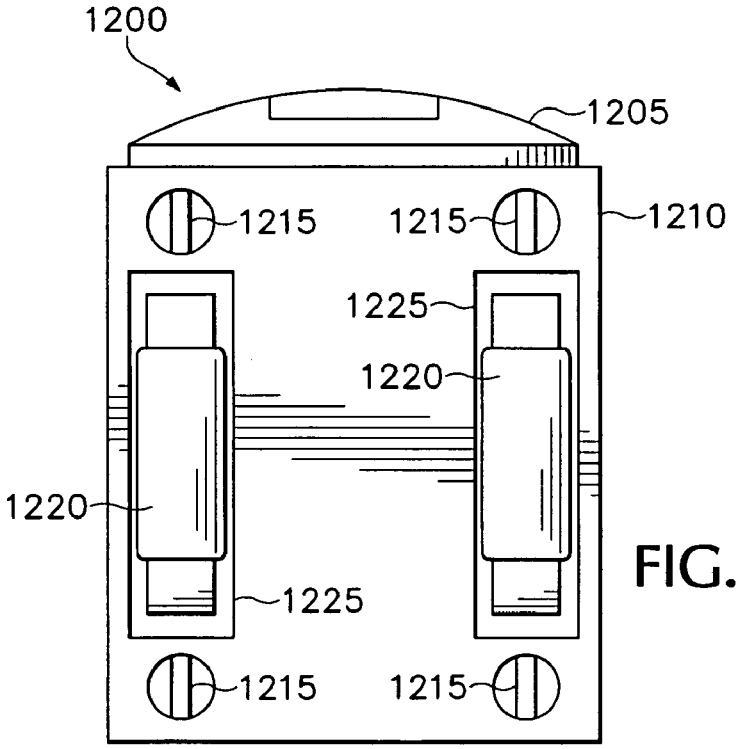

FIG. 12 illustrates a rearward view of a portable bottled water dispenser with an exemplary carrying frame, according to one embodiment of the invention.

Figure 13:
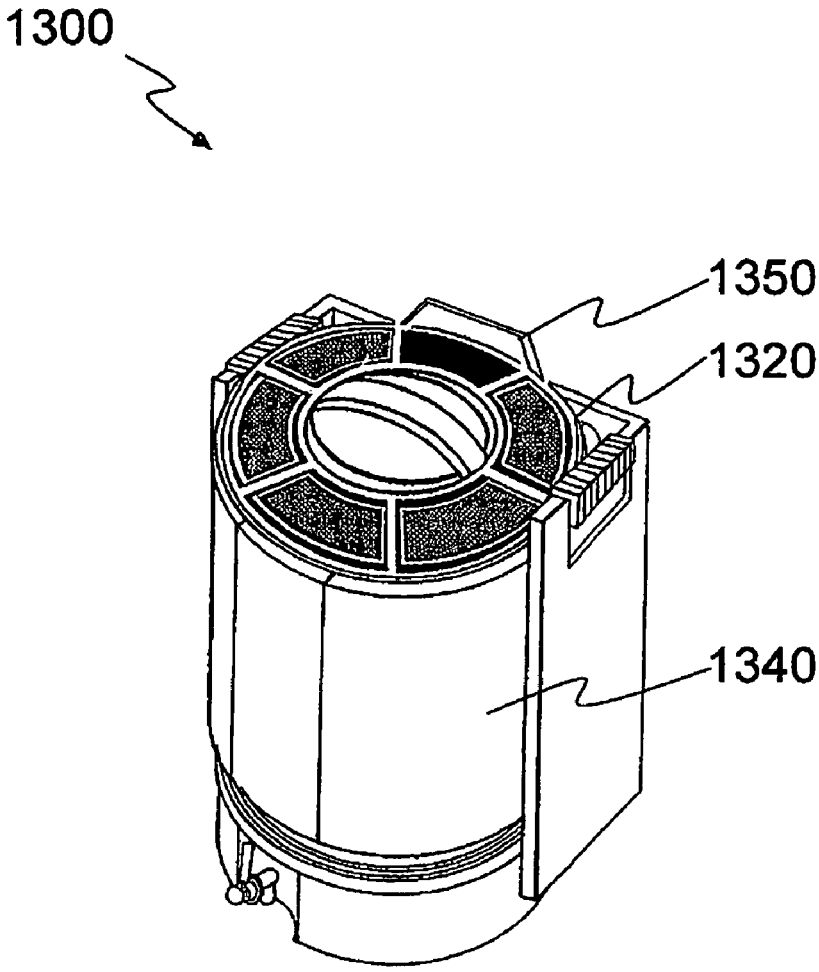

FIG. 13 shows a beverage dispenser having a solar panel as a power source for active heating or cooling elements within the dispenser, according to one embodiment of the invention.

Figure 14:
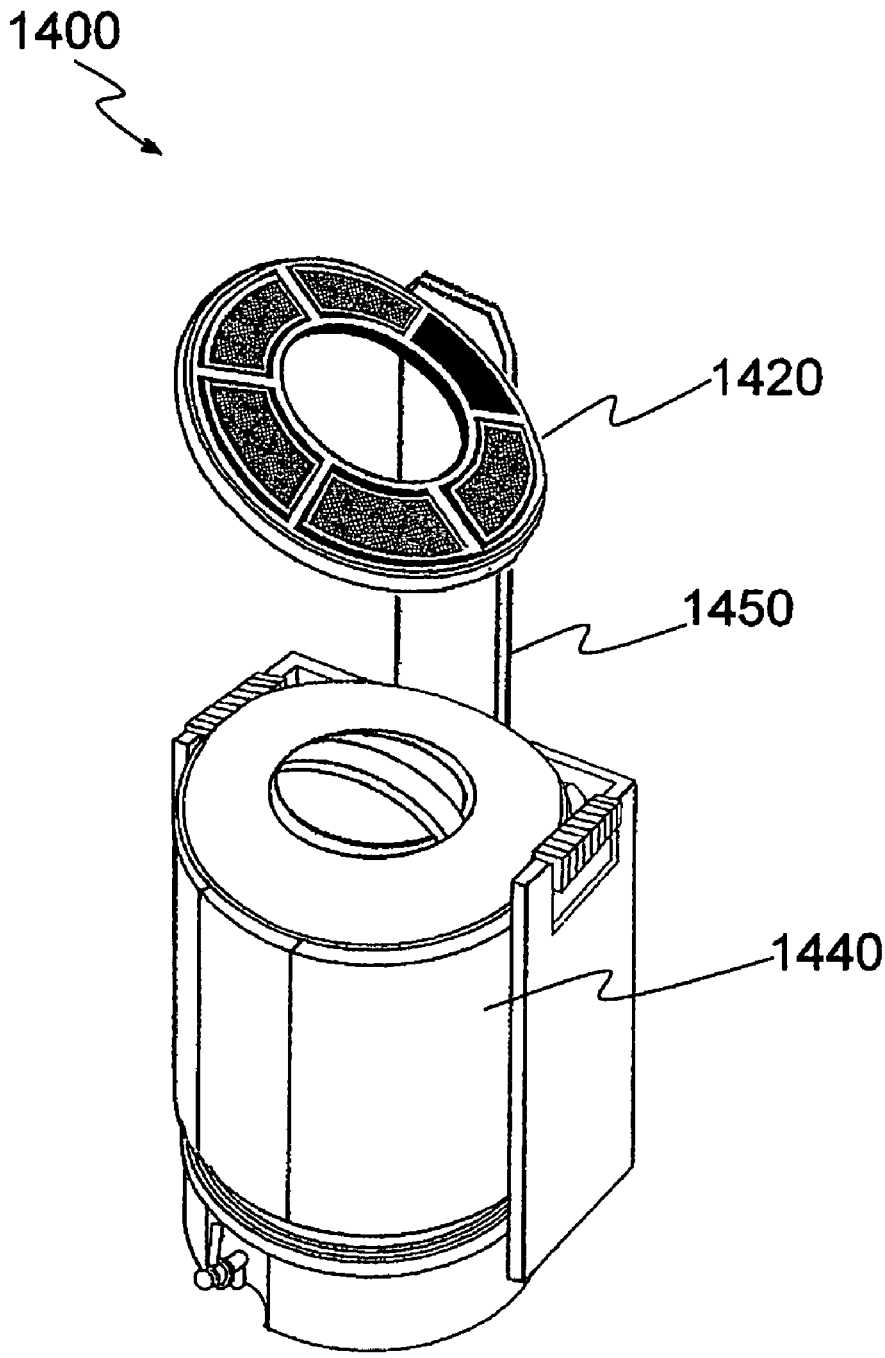

FIG. 14 depicts a beverage dispenser having a solar panel in an extended position and adjustably attached to an extendable arm feature, according to one embodiment of the invention.

Figure 15:
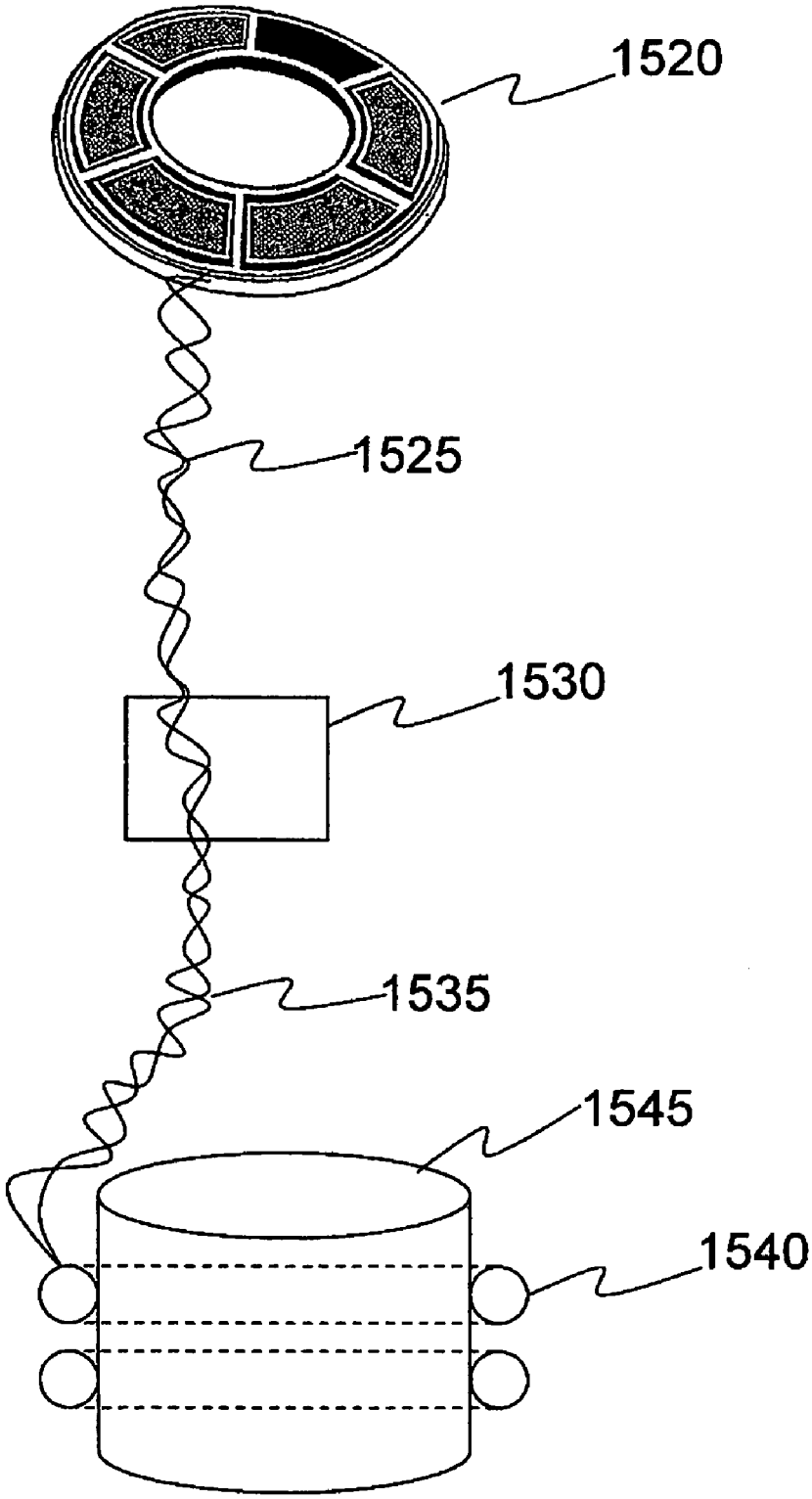

FIG. 15 is a component drawing of a disc shaped solar panel electrically connected with thermoelectric elements for heating or cooling liquid to be dispensed from the beverage dispenser, according to one embodiment of the invention.

DETAILED DESCRIPTION OF PREFERRED EMBODIMENTS

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Various operations will be described as multiple discrete steps performed in turn in a manner that is helpful for understanding the present invention. However, the order of description should not be construed as to imply that these operations are necessarily performed in the order they are presented, nor even order dependent.

In various embodiments, the present invention pertains to a portable apparatus for cooling and/or dispensing water using standard three- or five-gallon bottled drinking water, an apparatus for cooling and/or dispensing water using standard three- or five-gallon bottled drinking water integrated into a pickup or vehicle toolbox, an apparatus for actively chilling or heating water dispensed from standard three- or five-gallon bottled drinking water, other embodiments incorporating a compact or short profile dispensing device for receiving drinking water from three- or five-gallon bottled drinking water, and the methods associated with these devices. In various embodiments, the apparatus comprises a container for enclosing a standard sized bottle, a collar for supporting the bottle, a reservoir for receiving liquid from the bottle, and a spigot for dispensing the liquid from the reservoir.

The present invention, in one embodiment, comprises using standard three- or five-gallon bottled drinking water with the standardized dispenser caps, a collar for supporting the bottle, a reservoir for receiving water from the bottle, a spigot for dispensing the water from the reservoir, and space around the reservoir that may be filled with ice to cool the water in the reservoir. In one embodiment, the present invention comprises using standard three- or five-gallon bottled drinking water with the standardized dispenser caps, a collar for supporting the bottle, a reservoir for receiving water from the bottle, a spigot for dispensing the water from the reservoir, and elements thermally contacting the reservoir to heat or chill the water contained therein.

Figure 1:
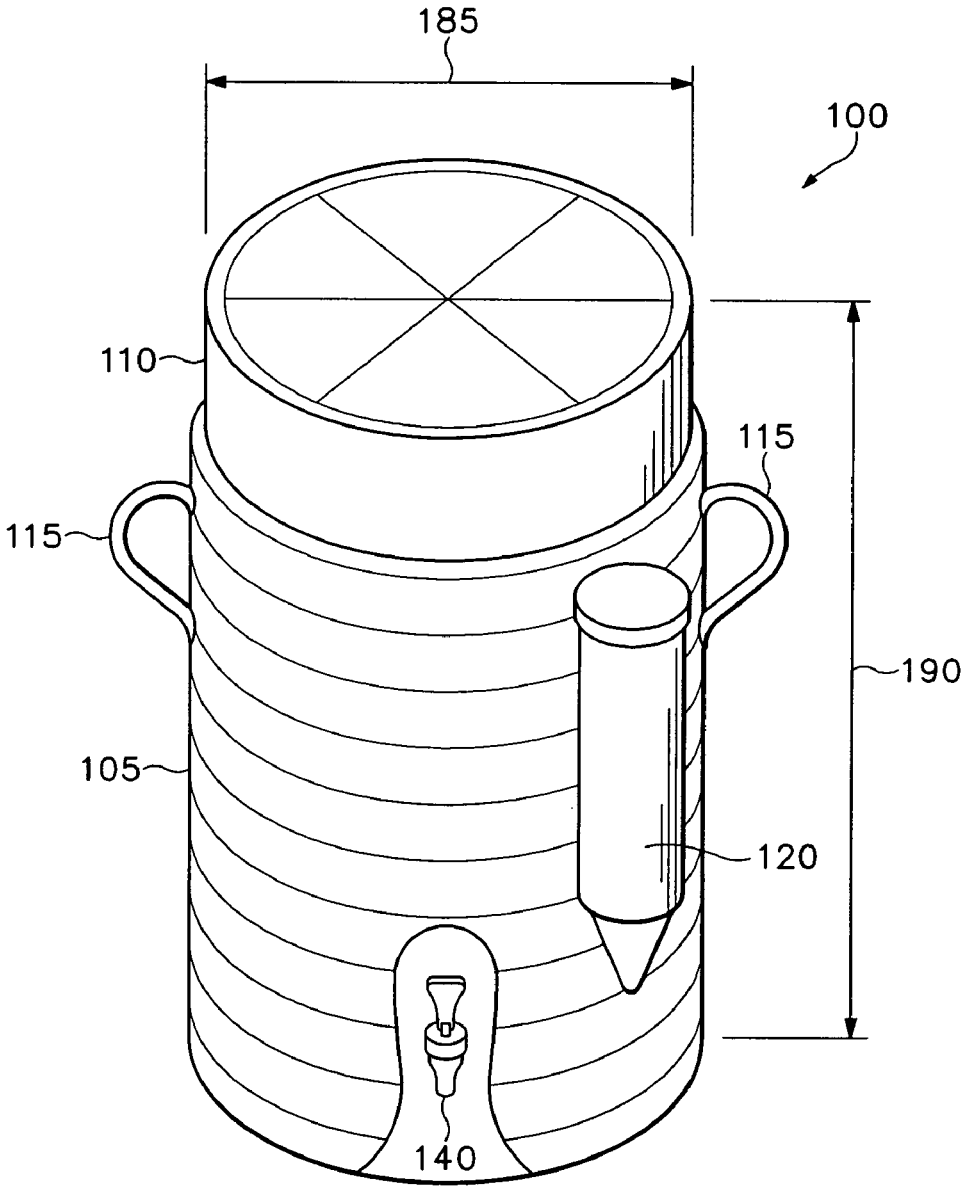
FIG. 1 illustrates a portable bottled water dispenser according to one embodiment of the invention.

In one embodiment, and illustrated in FIG. 1, the complete portable bottled water dispenser comprises an appropriately sized cylindrical cooler configuration that may be portably used just as other currently available cylindrical type coolers may be portably used. That is, in one embodiment, the present invention comprises a substitute for the currently available cylindrical type beverage coolers whereby sanitary bottled water (or another beverage) is dispensed instead of water (or another beverage) that is in direct contact with the interior surfaces of the cylindrical type cooler. The portable bottled water dispenser 100 may comprise, according to one embodiment of the invention, a cylindrically shaped container 105 within which standard sized water bottle (filled with water or another beverage) may be contained, a circular lid 110 that closeably mates with the container 105, and handles 115 for lifting the dispenser 100. The dispenser 100 may include a cup dispenser 120 from which cups may be dispensed for use with water or another beverage dispensed from the spigot 140. As shown in FIG. 1, in one embodiment, the dispenser may have a diameter 185 of approximately 13 inches and a height 190 of approximately 19 inches. These dimensions may vary considerably and are preferably optimally chosen to handle standard sized bottled water and to allow for a compact and short profile for the dispenser 100. For instance, a dispenser 100 with a diameter 185 of roughly 13 inches and a height 190 of roughly 19 inches may be most suitable for a dispenser 100 using standard 3-gallon sized drinking water bottles. Smaller dimensions may be used for a dispenser 100 that uses smaller bottles such as standard 2-gallon bottles. Larger dimensions may be used for a dispenser 100 that uses larger bottles such as 5-gallon or 6-gallon bottles.

As mentioned, a beverage other than water may be dispensed. For example, the standard sized bottle may be filled with a sports drink such as Gatorade® or any other liquid. p The present invention preferably uses standard sized bottles commonly used in the drinking water industry. Such standard sized bottles have a substantially cylindrical shape with a neck that may be placed within a receiving collar for supporting the bottle in an upside down (inverted) orientation for gravitationally dispensing the fluid contents of the bottle from the neck of the bottle directed downward. The standard sized bottles may be similar to a five-gallon water bottle produced by Reid Canada, Inc., sold under the name Aqualite® Bottle, and marked with U.S. design Pat. D339,067 (by Rokus, issued Sep. 7, 1993), which is incorporated in its entirety herein by reference. Several different bottle designs are available which use standard neck and overall diameter dimensions. Most are available in three- or five-gallon sizes. However, two-, four-, and six-gallon sizes may also be used as may be other sizes that preferably comprise standardized dimensions for use with existing floor standing type drinking water dispensers.

Figure 2:
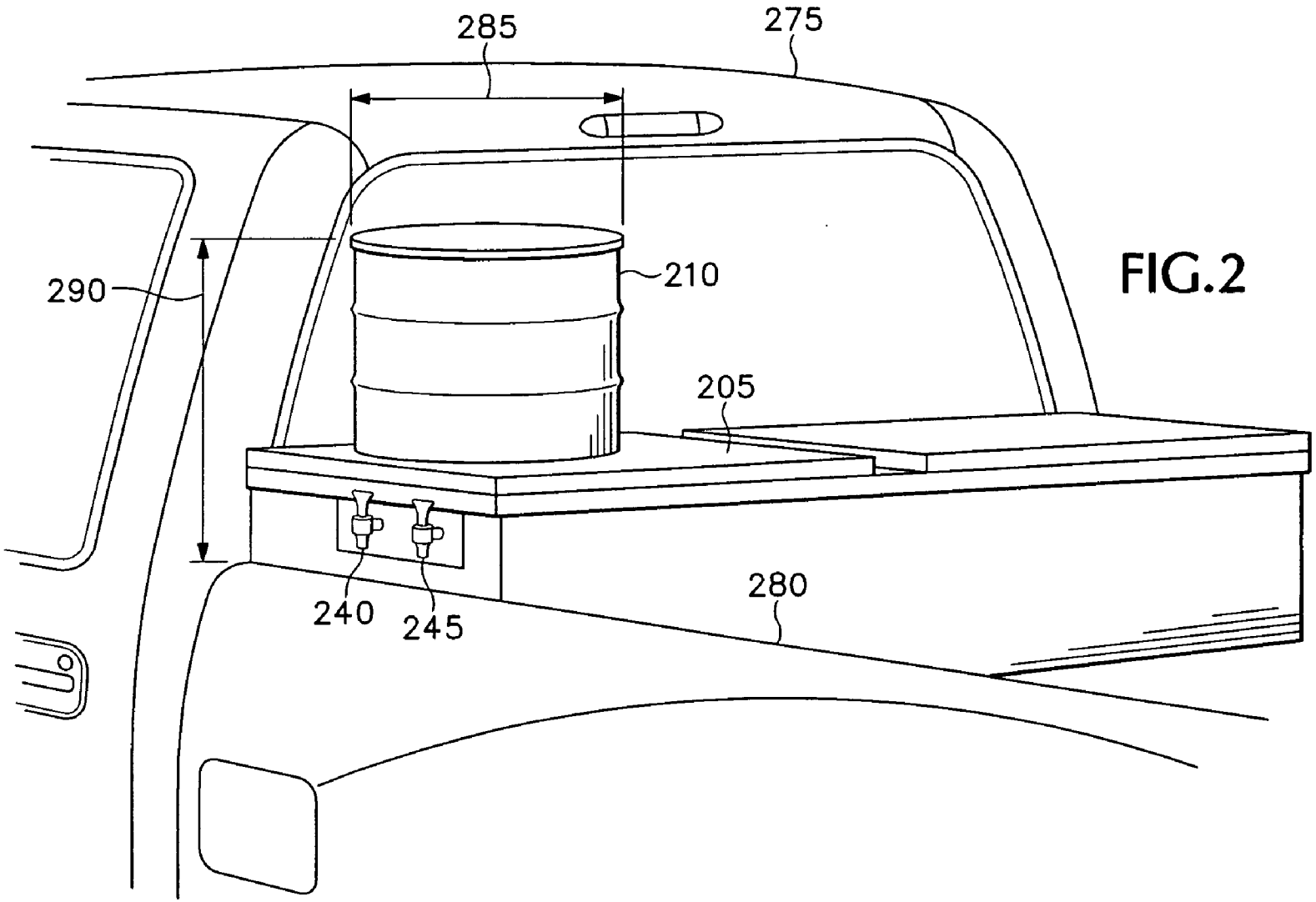
FIG. 2 illustrates a portable bottled water dispenser integrated into a vehicle toolbox, according to one embodiment of the invention.

In another embodiment, and illustrated in FIG. 2, the complete portable bottled water dispenser comprises a dispenser integrated within a vehicle utility box or pickup toolbox. The toolbox mounted dispenser offers contractors, construction workers, or any job site application a convenient source of sanitary drinking water. As shown in FIG. 2, in one embodiment, the dispenser may be mounted within a truck toolbox 205. In this configuration, a lid 210 may cover the standard sized bottled water thereunder. The lid 210 may function to retain or immobilize the bottled water, insulate the bottled water from temperature changes, or shield the bottled water from environmental conditions such as direct sunshine, exposure to dirt or debris, and so on. Spigots 240 and 245 may comprise hot and cold spigots, respectively, and may be located on the sidewalls of the toolbox 205 within the pickup bed of truck 275 so that the spigots are accessible above the sides 280 of the pickup bed. As shown in FIG. 2, in one embodiment, the toobox mounted dispenser may have a lid diameter 285 of approximately 13 inches and a height 190 (measured from the top edge of sides 280 to the top of lid 210) of approximately 22 inches. These dimensions may vary considerably and are preferably optimally chosen to handle standard sized bottled water.

As will be appreciated, the apparatus may be installed differently within the toolbox shown in FIG. 2. For example, the dispenser may be installed on the opposite side of the toolbox or in the middle, or elsewhere. Indeed, the present invention is not limited to integration within a toolbox as shown in FIG. 2. The apparatus may be integrated into any vehicle utility space. In one embodiment, the dispenser apparatus may be integrated into the rear truck bed compartments of a vehicle such as a telephone repair vehicle or other similar utility vehicle.

An alternate embodiment may comprise the components of the toolbox dispenser as shown in FIG. 2 without a lid 210. That is, in one embodiment, the toolbox may be configured with an appropriately sized hole within the top surface of the toolbox 205, sized for receiving a standard sized bottle (such as a 3- or 5-gallon bottle), as well as spigots 240 and 245 and other associated components associated with the dispenser (not shown). In this configuration, the inverted standard sized water bottle (as received by the tool box dispenser unit) is exposed above the surface of the toolbox 205. Such a configuration may be preferable in job site situations involving frequent water bottle changes (high water usage), active systems within the toolbox 205 for chilling or heating the water (or beverage) to be dispensed, or other circumstances reducing the benefits of having a lid 210.

The embodiments depicted in FIGS. 1 and 2 may comprise active heating and/or active cooling elements within their respective structures. For example, the dispenser 100 in FIG. 1 may include active cooling/heating elements within the lower portion of the container 105 so that cooled or heated water (or beverage) may be dispensed from spigot 140. The active cooling/heating elements may be powered by batteries within the structure of dispenser 100, a standard 12v automotive style adaptor that plugs into the elements or a suitable plug feature within the dispenser 100, a solar panel associated with the dispenser 100, or variations thereof. Other sources of power may be used, and other configurations to incorporate the active cooling/heating elements may be used. For example, in a toolbox dispenser as shown in FIG. 2, the active cooling/heating elements may be powered by the 12v automotive system via wiring routed through truck sides 280 or some other suitable wire routing. As will be discussed in more detail further below, one or more solar panels may be associated with the dispensing system.

Figure 3:
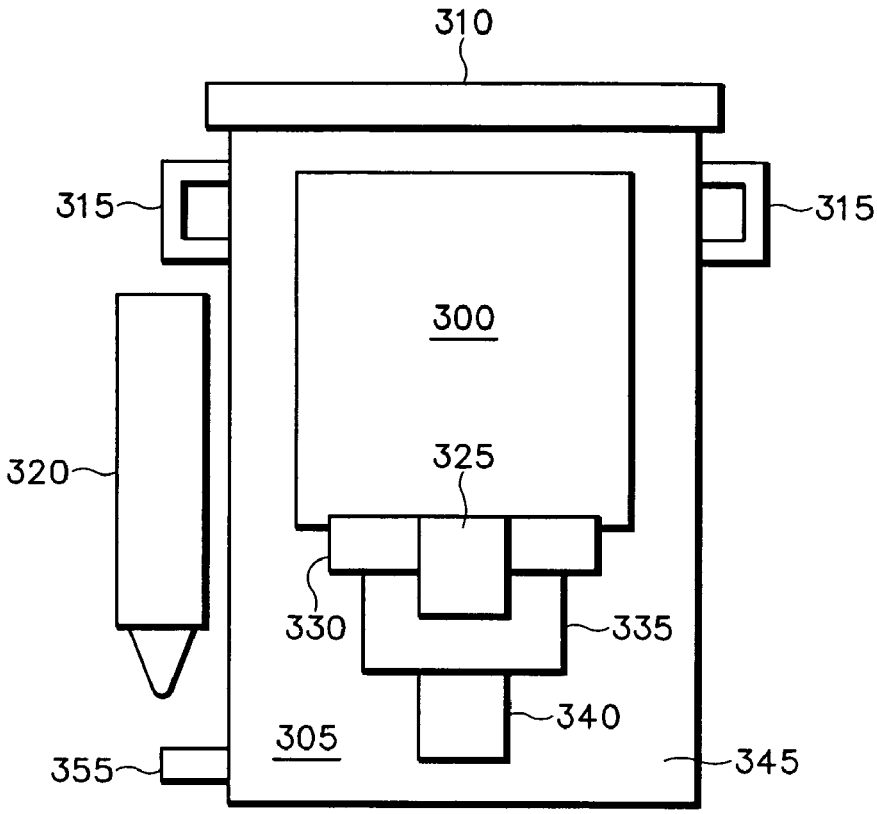
FIG. 3 illustrates a sectional view of a portable bottled water dispenser according to one embodiment of the invention.

FIG. 3 is intended to show the present invention, in one embodiment, in functional detail. In one embodiment, the present invention comprises a drinking water cooler that looks very similar to common cylindrical type coolers except that the cooler dispenses bottled drinking water instead of water held directly within the interior compartment of the cooler. As shown in FIG. 3, a container 305 with drain plug 355 and lid 310 is provided. In one embodiment, the container 305 is made of an insulated plastic, similar to the materials used for food or beverage coolers (such as currently produced cylindrical type coolers). A variety of materials may be chosen. Handles 315 may be provided to assist with portability. In one embodiment, a cup dispenser 320 may be provided.

In one embodiment, a three-gallon standard water bottle 300 commonly supplied to offices and the like may be fully enclosed within the container 305 and lid 310, as shown in FIG. 3. The container 305 and/or lid 310 may comprise an insulated construction for managing the temperature within the contained space (within which the bottle 300 may be contained). Preferably, the material enclosing the space for a standard sized bottle comprises a rigid opaque material. In one embodiment, the enclosing material is rigid opaque molded plastic.

In one embodiment, a five-gallon bottle 300 may be used. In one embodiment, the present invention comprises a three-gallon bottle 300 with the aforementioned container 305 and supported by a collar configuration comprising the standard bottled water dispenser interface 330. This interface (or collar supporting bottle) 330 is used throughout the bottled water industry and is well known to those skilled in the art. The collar support structure, as shown, supports the bottle 300 (receiving the neck of the water bottle 325) and mates with a reservoir 335, and the reservoir 335 gravitationally feeds the drinking water through a spigot 340 for dispensing water (or another beverage) to a consumer. The neck of the water bottle 325 preferably extends downward through the aperture (or center hole) of the collar 330 and into the interior (liquid holding) space of the reservoir 335. A variety of materials may be used for these components. In one embodiment, the reservoir 335 comprises a metallic bowl shaped or cylindrically shaped chamber. In one embodiment, the reservoir 335 comprises a stainless steel water holding chamber. A metallic construction for the reservoir 335 is used to enhance the heat transfer from the water to the cooling ice or other ice substitute that may be filled into the space 345 around the reservoir and bottle of water 300, in one embodiment.

In one embodiment, the space (or cavity) around the bottle 300, supporting collar 330, reservoir 335, and spigot 340 connections may be filled with ice, ice packs, or some other coolant. In one embodiment, a reusable coolant material may be used instead of ice. In one embodiment, a freezable gel (sometimes called blue ice) comprises the coolant material and may be inserted into the space between the interior container wall and the exterior of the bottle 300, collar 330, reservoir 335, and so forth.

In one embodiment, the reservoir 335 comprises a cylindrical chamber thermally coupled with a circumferentially shaped space for ice or another coolant, the circumferentially shaped space forming a circular trough within which coolant material such as ice and through which heat is transferred from the water in the reservoir 335 to the coolant material surrounding the reservoir and thermally in contact with this circular trough. In one embodiment, the circular trough comprises a metallic construction. In one embodiment, the circular trough comprises the lower portion of the interior surfaces of the container. In one embodiment, the circular trough comprises larger portions of the interior surfaces of the container containing the three- or five-gallon standard bottles, the larger size improving the heat transfer from the drinking water to the coolant material in the space between the container interior surfaces and the bottle/collar/reservoir exterior surfaces.

Figure 4:
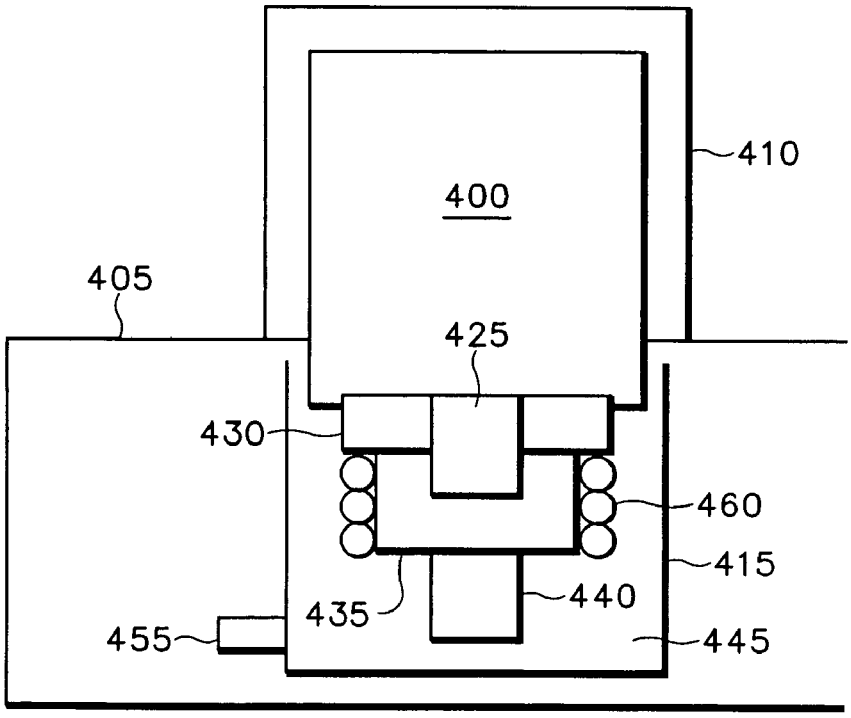
FIG. 4 illustrates a sectional view of a portable bottled water dispenser integrated into a vehicle toolbox, according to one embodiment of the invention.

FIG. 4 illustrates the present invention, according to one embodiment, comprising a bottled water dispenser integrated into a truck bed toolbox 405. As shown, in one embodiment, a lid 410 may be used to cover the exposed portion of the three- or five-gallon standard sized water bottle 400. The lid 400 may function to keep the water out of direct sunlight and thereby helps to keep the water from heating up. The lid may also function to retain or immobilize the bottle. In one embodiment, the bottle 400 (and its neck structure 425) are supported by a collar 430 and so on as in FIG. 3. In one embodiment, a lower container portion 415 is used to contain the collar 430, reservoir 435, spigot 440, and so forth, and provides space 445 for ice or another coolant material. A drain 455 may be provided for draining the melted ice.

Also shown in FIG. 4, cooling and/or heating elements 460 may be suitably positioned about the reservoir 435, in one embodiment, so as to provide a heating and/or cooling capability. The elements or coils 460 may be made of a wide variety of materials. As will be appreciated, the elements 460 may be disposed on the surface of the reservoir 435 in a variety of ways or even integrated into the reservoir structure itself. Associated compressors, pumps, element linkages, temperature controls, power supply considerations, and so forth are not shown as they are well known or may be suitably designed using a wide variety of commercially available components. Such components may be disposed anywhere within the truck bed toolbox 405 or anywhere on the vehicle hosting the toolbox 405. Such components may comprise solar cells or solar panels suitably disposed on the toolbox 405 so as to provide a source of power for the active cooling/heating elements 460.

In one embodiment, the elements 460 may comprise Peltier or other types of thermoelectric elements thermally coupled with the reservoir 435 and/or linkages to the spigot 440 for cooling or heating of the fluids therein. Any of a wide variety of available Peltier or other types of thermoelectric elements may be used. As is well known, Peltier elements convert a voltage difference into a temperature gradient within a material substrate and are frequently used for cooling PC components, especially overdriven or modified computer processors. Typical Peltier elements cool on one side and heat on the other. Incorporation of thermoelectric elements within the space 445, in one embodiment, provides cooling or heating of the fluid to be dispensed depending upon the polarity of the voltage applied to and the configuration of the thermoelectric elements. In one embodiment, the elements 460 may comprise thermoelectric elements configured to cool the reservoir 435 and utilize the space 445 for dissipating the heat generated by the elements 460. The space 445 may include air ways for dissipating heat generated by the elements 460. One or more fan (not shown) may be included to increase the volume of air available for dissipating heat generated by the elements 460.

Referring back to FIG. 3, in one embodiment, active elements such as elements 460 may be included within the space 345 as described and illustrated in FIG. 4. That is, although the dispenser illustrated in FIG. 3 is shown as a passive device whereby the fluid to be dispensed is cooled by ice or other passive means, the dispenser illustrated in FIG. 3 may be configured in similar fashion as the dispenser illustrated in FIG. 4 with active means for cooling (or heating) the fluid to be dispensed.

The dispenser illustrated in FIG. 3 may comprise active cooling/heating elements 460 shown in FIG. 4 suitably positioned about (preferably in thermal contact with) the reservoir 335, in one embodiment, so as to provide a heating and/or cooling capability, for selectively heating or cooling the liquid within the reservoir 335. Further, the dispenser in FIG. 3 may include associated means for powering such active cooling/heating elements, including, but not limited to, battery power, solar power, and motion (motion-winding-mechanical) power. In one embodiment, an array of solar cells or a solar panel may be disposed on lid 310 or lid 410 or on another suitable surface, such as, for example, a surface on truck toolbox 405.

Figure 5:
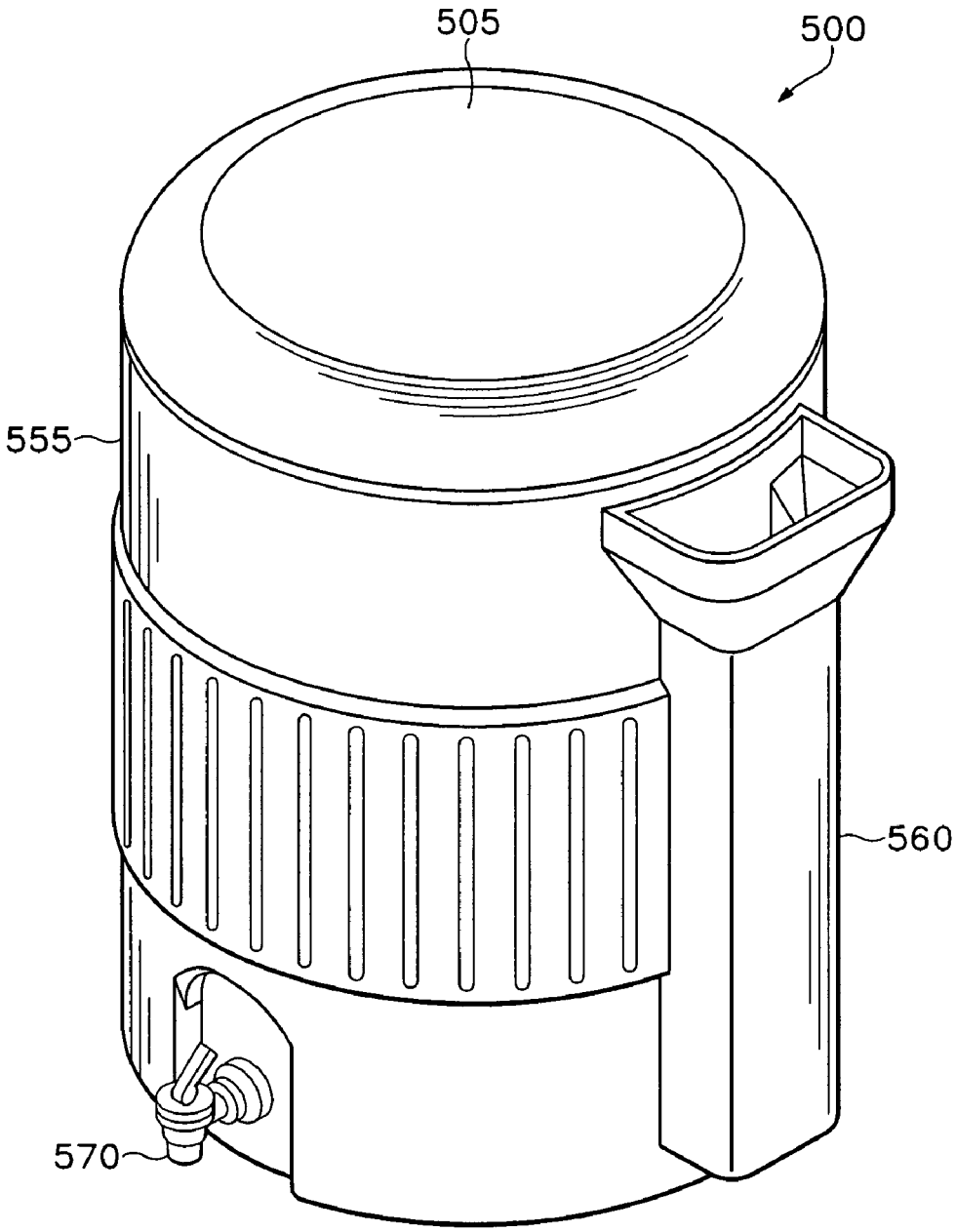
FIG. 5 illustrates an isometric view of a portable bottled water dispenser with an ice loading chute, according to one embodiment of the invention.

Moving on, FIG. 5 illustrates an isometric view of a portable bottled water dispenser 500 with an ice loading chute 560, according to one embodiment of the invention. As shown, the portable bottled water dispenser 500 comprises a lid 505 for covering a cylindrical container 555 having an ice loading chute 560 and a dispensing spigot 570. Once a standard sized bottled is placed within the container 555, it may be difficult to add ice into the container 555 for cooling the fluid to be dispensed. The chute 560 provides access to the lower portion of the dispenser 500 where the reservoir is located and whereby the fluid to be dispensed may be most effectively cooled. In one embodiment, ice may be inserted at the top end of the chute 560 (near the lid 505). Ice may then pass from the chute 560 into the container 555 through one or more holes between the chute 560 and the container 555.

Figure 6:
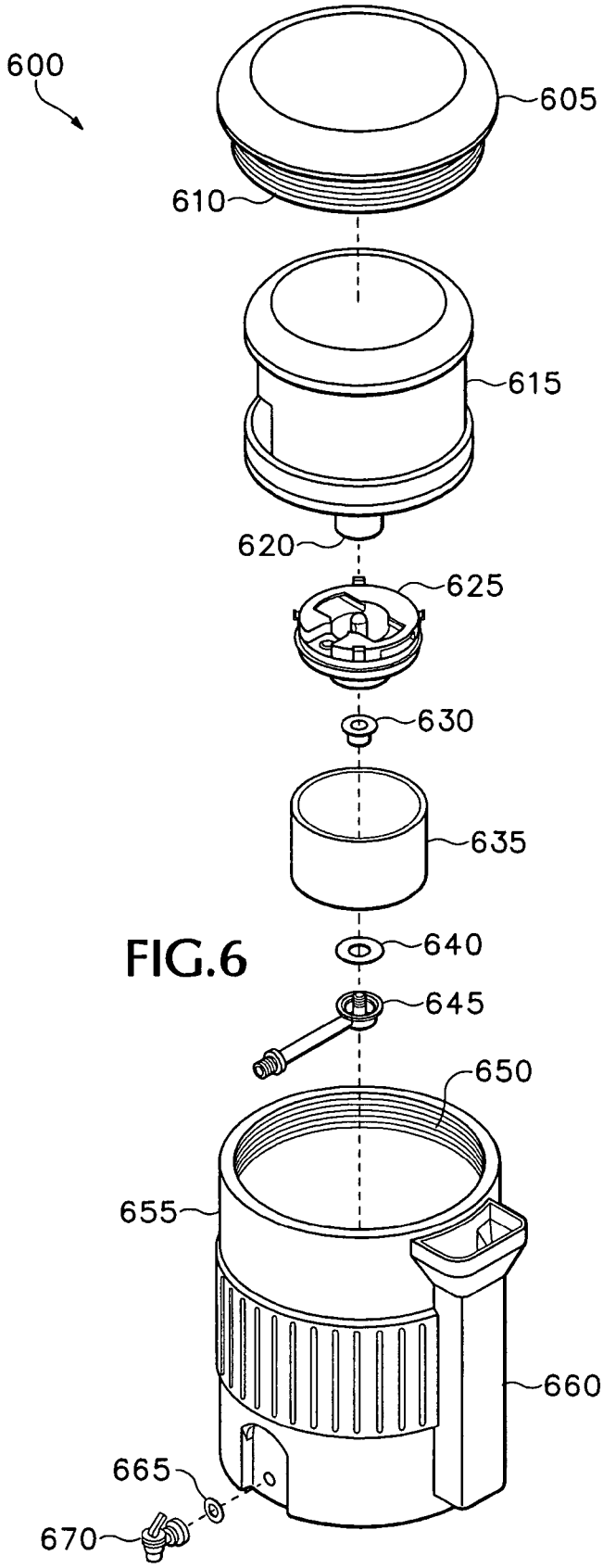
FIG. 6 illustrates an exploded view of the portable bottled water dispenser shown in FIG. 5.

Next, FIG. 6 illustrates an exploded view of the portable bottled water dispenser shown in FIG. 5. As shown, the portable bottled water dispenser 600 may include an ice cube chute 660. The portable bottled water dispenser 600 may comprise a lid 605 with threads 610 for engaging with mating threads 650 on a cylindrical container 655. Alternatively, the lid 605 may include an interference fit surface 610 suitably designed to fit snugly and retainably with a mating interference fit surface 650 disposed upon the container 655.

Within the container 655, a standard sized bottled 615 with neck 620 gravitationally rests upon a supporting collar 625 (sometimes called a water guard). As shown, the water guard 625 fits into a reservoir 625 and connects with a fluid dispensing tube 645 which is sealed to the reservoir 625 with a tube gasket 640 and a tube connection nut 630. The fluid dispensing tube 645 protrudes through the lower portion of the container 555 and a sealing washer 665 before connecting with a spigot 670. When the spigot 670 is opened water or fluid within the bottle 615 is permitted to flow downward through the water guard 625 and into the reservoir 615 and water dispensing tube 645 and out the spigot 670.

Figure 7:
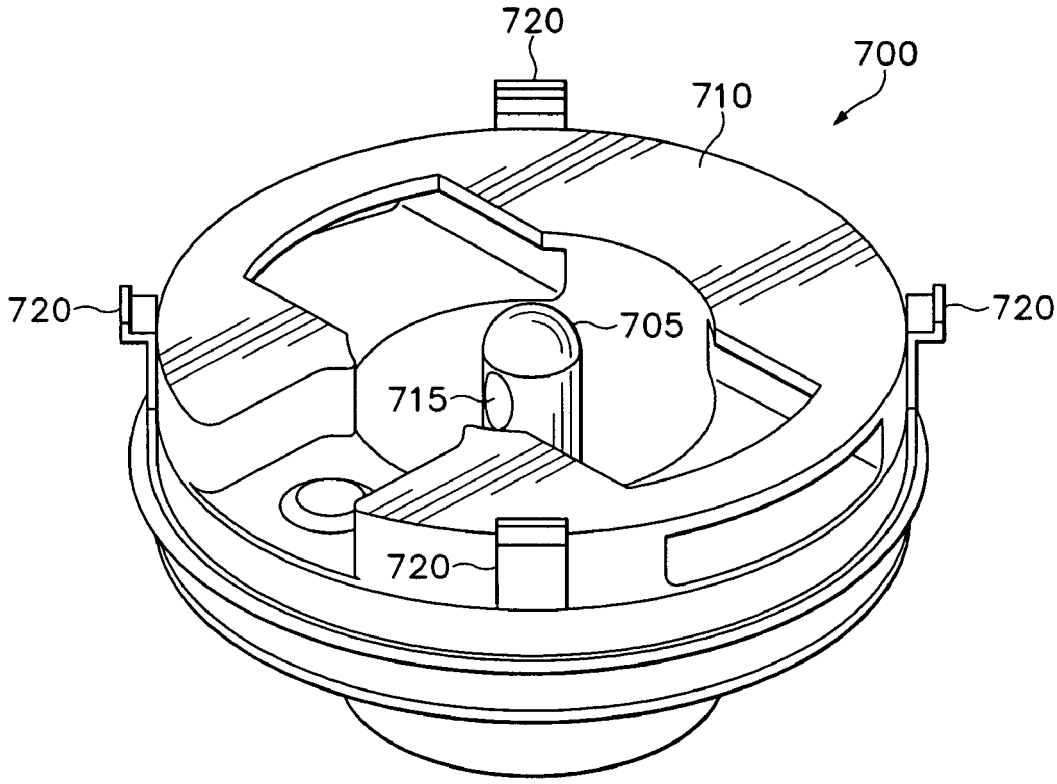
FIG. 7 illustrates an exemplary water guard for use with a portable bottled water dispenser according to one embodiment of the invention.

FIG. 7 illustrates an exemplary water guard 700 for use with a portable bottled water dispenser according to one embodiment of the invention. The water guard 700 shown is representative of water guards commonly used with standard sized bottled water. A stem 705 penetrates the neck of the standard sized bottle when the bottle is lowered down over and into the water guard 700. A bearing surface 710 supports the bottle (as may other portions of the water guard 700). Water or fluid from within the bottle may flow through the inlet 715 to fill the reservoir. Retaining clips 720 may be used to retain the water guard 700 within the reservoir, preventing the water guard 700 from slipping into the reservoir more than necessary to engage a connection seal 725 for sealing the water guard 700 and the inside surface of the reservoir.

Other styles of water guards or supporting collars may be used. For example, the supporting collar 700 may exclude the stem 705. The supporting collar 700 may include a bearing surface 710, retaining clips 720, a connection seal 725, and an inlet disposed at the lowest portion of the supporting collar 700 and aligned with the center of the portion formed for receiving the neck of a standard sized water bottle.

FIGS. 8*a* and 8*b* illustrate an exemplary reservoir for use with a portable bottled water dispenser according to one embodiment of the invention. The reservoir may comprise any of a wide variety of materials, shapes, and sizes. The reservoir, in one embodiment, preferably comprises a cylindrical shape with exterior sides 805, an interior 810, a bottom surface 815, and a drain hole 820.

The reservoir is preferably made of a metallic material that is thermally conductive so that the interior of the reservoir may be cooled more effectively. For instance, ice or another coolant in contact with the exterior sides 805 will more effectively draw heat out of fluid within the interior 810 if the reservoir is made of a thermally conductive material. Cooling (or heating) elements may be positioned around the exterior sides 805 or bottom surface 815.

FIG. 9 illustrates an exemplary drain tube 900 for use with a portable bottled water dispenser according to one embodiment of the invention. As shown, the drain tube 900 includes an attachment end 905 for fluidly connecting the drain tube 900 to a reservoir such as the reservoir shown in FIGS. 8*a* and 8*b*, a tube 910, and a spigot connection 915 for fluidly connecting the drain tube 900 with a spigot such as the spigot 670 shown in FIG. 6. The drain tube 900 may be used for delivering fluid from a reservoir to a dispensing spigot and may comprise any of a wide variety of materials. In one embodiment, the drain tube 900 comprises a plastic material. In another embodiment, the drain tube 900 comprises a thermally conductive material such as a metallic material so that ice or other coolants may draw heat from the fluid within the drain tube 900 thereby cooling the fluid to be dispensed. Although not shown, active cooling (or heating) elements may be disposed on the drain tube 900 to cool (or heat) the fluid within the drain tube 900.

Next, FIG. 10 illustrates an isometric transparent view of a portable bottled water dispenser 1000 with carrying frame 1005, according to one embodiment of the invention. As shown, the portable bottled water dispenser 1000 comprises a carrying frame 1005 with recessed tie down holes 1010 for attaching the carrying frame 1005 to a removable cooler top 1040 and a cooler base 1085. Preferably, the dispenser 1000 comprises a carrying frame 1005 with recessed tie down features 1010 for attaching the dispenser 1000 to various structures. Such structures may include, but are not limited to, a motor vehicle (such as a pickup bed), a chain link fence or bench (perhaps at a sporting event), or any desired structure.

The carrying frame 1005 may include handles 1020 with handle reliefs 1025. The removable cooler top 1040 may include an integral lid 1030 with lid handle 1035. In one embodiment, the removable cooler top 1040 and the integral lid 1030 together form an integrated top. The removable cooler top 1040 may substantially cover the standard sized water bottle space within the portable bottled water dispenser 1000. The removable cooler top 1040 may cover 90% of the height of the standard sized bottle (or 80%, 70%, 60%, 50%, 40%, 30%, and so on). Preferably, the removable cover top 1040 covers over 50% of the height of the standard (3- or 5-gallon) sized water bottle so as to permit easy replacement of the bottle.

The removable cooler top 1040 may be securely fastened to the cooler base 1085 using a strap, latch, lock, or other mechanism. Such a securing mechanism preferably holds the standard sized bottle firmly to the receptacle or water guard so as to minimize leakage when the dispenser 1000 is moved. As will be appreciated, such a securing mechanism may be used with any of the embodiments described herein. For instance, the dispenser mounted within a truck toolbox as in FIG. 2 preferably uses a securing mechanism to minimize leakage when the truck carrying the dispenser is moved.

Also shown in FIG. 10, are various components such as a water guard 1045 a reservoir 1050, a water dispensing tube 1070, a spigot 1080, and a waste drain 1090. Although the footprint of the portable water dispenser 1000 is illustrated as circular (defined by the cylindrical removable top cover 1040 and cooler base 1085) with a rectangular carrying frame 1005, the footprint may comprise a semi-circular, semi-rectangular outline defined by a cooler base 1085 that is semi-circular on one side (a front side) and rectangular on the other side (a back side). That is, the cooler base 1085, in one embodiment, may be non-cylindrical to better mate with a substantially rectangular carrying frame 1005. Furthermore, although various components appear to be distinct and separate, components may be combined where manufacturing processes allow. For instance, the removable cooler top 1040 and the integral lid 1030 may comprise a single molded piece. Likewise, the cooler base 1085 and the carrying frame 1005 may comprise a single molded component. Other combinations may be made without altering the intended scope of the invention described herein.

FIG. 11 illustrates an exploded view of the portable bottled water dispenser with shoulder straps shown in FIG. 10. As shown, a portable bottled water dispenser 1100, may comprise a carrying frame 1105 with recessed tie down holes 1110, recessed shoulder strap holes 1115, handles 1120, and handle reliefs 1125. A lid 1130 with lid handle 1135 may be integral to a removable cooler top 1140 which covers a substantial portion of the height of a standard sized (3- or 5-gallon) water bottle. A water guard 1145 is disposed for supporting the standard sized water bottle and allowing water to flow out of the water bottle and into a reservoir 1150 below the water guard 1145. A water dispensing tube 1170 is shown with a tube gasket 1165 and a tube connection nut 1160 for attaching the water dispensing tube 1170 to the reservoir 1150. A dispensing spigot 1180 is shown with a sealing washer 1175 for sealably connecting the spigot 1180 with the dispensing tube 1170 through the cooler base 1185. Reusable blue ice packs 1155 (or similar refreezable packs) may be used for cooling the water held within the reservoir 1150 and dispensed through the water dispensing tube 1170 and spigot 1180. Also, a waste drain 1190 is shown for allowing melted ice, condensation, or other fluids to drain from the cooler base 1185.

Next, FIG. 12 illustrates a rearward view of a portable bottled water dispenser 1200 with an exemplary carrying frame, according to one embodiment of the invention. As will be appreciated, the rearward view shown illustrates a compact and short profile for the dispenser 1200. The lid portion of a removable cooler top (such as the removable cooler top 1140 in FIG. 11) is shown extending slightly above the top of the carrying frame 1210. This portion may be greater depending upon the size of water bottle used. For example, the portion of the removable cooler top extending above the top of the carrying frame 1210 may be greater when a 5-gallon sized water bottle is used than when a 3-gallon sized water bottle is used. In one embodiment, the only difference between a portable bottled water dispenser 1200 using a 3-gallon sized water bottle and a portable bottled water dispenser using a 5-gallon sized water bottle may be the height of the removable cooler top used. All other components between the two different sized dispensers may be the same. That is, in one embodiment, the cooler base and carrying frame may be used for both 3- and 5-gallon water bottle dispenser configurations with only the removable cooler tops (as differently sized components) lacking interchangeability.

As shown in FIG. 12, the carrying frame 1210 may comprise recessed tie down features 1215 and retractable recessed shoulder straps 1220 which may be recessed within recessed shoulder strap holes 1225. The tie downs 1215 may be used to secure the dispenser to a vehicle utility box (such as those commonly found on road construction or utility trucks), a bench (such as a typical seating bench at a baseball field or other sporting event), chain link fence, or some other structure. For example, the recessed tie down features 1215 may comprise a recessed vertical member to which a standard S-hook may be attached. S-hooks may then be used to strap the dispenser (attached to the carrying frame 1210) to the desired structure.

The shoulder straps 1220 may be used to haul the portable bottled water dispenser (filled or unfilled) from location to location. The shoulder straps 1220 may be retractable so as to retract inward within the carrying frame 1210 (toward the enclosure for the standard sized bottle and other dispenser components). The mechanism for retracting the shoulder straps 1220 may comprise a roller device similar to those used with automobile seat belts. In the retracted position, the shoulder straps 1220 may be completely recessed within the carrying frame 1210 for preventing the straps from catching on obstacles when the portable bottled water dispenser is moved from place to place. In one embodiment, the carrying frame 1210 comprises a slightly contoured but substantially flat backed carrying frame. The back area of the carrying frame 1210 may be slightly contoured for more comfortable carrying using the shoulder straps 1220. Any of a wide variety of materials may be used for constructing the carrying frame 1210. In one embodiment, the carrying frame 1210 may be molded plastic.

FIG. 13 shows a beverage dispenser 1300 having a solar panel as a power source for active heating or cooling elements within the dispenser, according to one embodiment of the invention. As illustrated, the beverage dispenser 1300 may comprise a container 1340 for dispensing a liquid beverage. The container 1340 may comprise a conventional cooler wherewithin a liquid beverage may be introduced and later gravitationally dispensed through a spigot near the bottom of the dispenser. In another embodiment, the container 1340 may comprise the aforementioned structures for accepting standard sized bottles such as the standard 3- or 5-gallon sized bottled water bottles frequently used with floor standing bottled water dispensers. In one embodiment, the container 1340 comprises all of the features and structural elements of FIG. 11. That is, in one embodiment, the container 1340 comprises all of the features shown in FIG. 11 so that standard 3- or 5-gallon sized bottles may be used. Likewise, in various embodiments, the container 1340 may comprise any of the dispensers depicted in FIGS. 1, 2, 3, 4, 5, 6, 10, and 11 and further include any of the features shown in such Figs. as well as in FIGS. 7, 8*a*, 8*b*, 9, and 12.

Also shown in FIG. 13 is a solar panel 1320, illustrated here as an arrangement of one or more solar cells into a ring-shaped panel. The solar panel 1320 may comprise another shape. However, the solar panel 1320 preferrably has a circular shape (with solar cells or solar panel material filling the center area) or ring-shape (with solar cells or solar panel material filling only an outer ring area), and it is preferable that such solar panel 1320 is disposed on the top surface or lid of the beverage dispenser 1300. It is further preferable that such solar panel 1320 have a separate structure from the container 1340 so that the solar panel 1320 may be removed. In a preferred embodiment, the solar panel 1320 is adjustably attached to the end of a telescopically extendable boom 1350 (shown in FIG. 13 in a retracted position). The telescopically extendable boom 1350 may be mounted to one side of the container 1340 and may have a structure similar to the telescopically extendable handles used on hand portable luggage bags. The telescopically extendable boom 1350 may comprise a double tube structure connected at the top, effectively forming a hand hold or handle, and attached along the side of the beverage container 1340 in the same way that a telescopically extendable handle is attached to a portable travel bag or luggage.

FIG. 14 depicts a beverage dispenser 1400 having a ring-shaped solar panel 1420 in an extended position and adjustably attached to an extendable arm feature (or telescopically extendable boom) 1450, according to one embodiment of the invention. As shown, the solar panel 1420 is preferably adjustably mounted to the extendable and retractable boom 1450 so that the solar panel 1420 may be repositioned or reoriented to point toward a solar energy source (such as the sun or appropriate light source). The adjustable mounting device (not shown in detail) may be an attachment that allows the solar panel 1420 to move with one or more degrees of freedom. That is, for example, the adjustable mounting device may allow for rotational (rolling) and tipping (pitching) movements whereby the solar panel 1420 may be positioned at nearly any angle with respect to the extendable boom 1450 and the container 1440.

Finally, FIG. 15 is a component drawing of a disc- or ring-shaped solar panel 1520 electrically connected to thermoelectric elements 1540 for heating or cooling liquid to be dispensed from the beverage dispenser, according to one embodiment of the invention. As shown, the ring-shaped solar panel 1520 is connected to the thermoelectric elements 1540 (as previously described and illustrated in FIG. 4) via electric wires 1525 and 1535 optionally running through a power device 1530 (which may comprise a transformer, battery source, switch circuitry, control circuitry, a miotion-winding power mechanism, or other power related circuitry). The power device 1530 may be unnecessary for some embodiments. For example, depending upon the selection of thermoelectric elements 1540 and solar cells comprising solar panel 1520, the voltage supplied by the solar panel 1520 may be appropriately matched to the voltage requirements of the thermoelectric elements 1540 so that a power device 1530 for conditioning or transforming voltages is not needed.

As shown, reservoir 1545 is thermally coupled with the thermoelectric elements 1540. However, other configurations are possible. For example, the thermoelectric elements 1540 may be chosen to be of a type that may be used in direct contact with the liquid beverage within the liquid holding container, or the thermoelectric elements 1540 may be appropriately chosen and integrated into the wall material of the container 1340 (shown in FIG. 13).

The embodiment illustrated in FIG. 15 includes the solar panel 1520 as a power source for the heating/cooling or thermoelectric elements 1540. In other embodiments, the thermoelectric elements 1540 may be powered by batteries (within power device 1530), a 12 volt automotive style power adapter (with or without a power device 1530, depending upon voltage requirements of the thermoelectric elements 1540 and depending upon whether batteries or other features are desired), or a mechanical motion winding type of mechanism that uses kinetic energy or motion to capture mechanical energy which can then be converted into a voltage for operation of Peltier or other types of thermoelectric elements needed to cool (or heat) the liquid beverage.

As described above, the solar panel (as shown in any of FIGS. 13–15) may be associated with the lid portion of the dispenser (for example, lids 110, 310, 410, 505, and 605), and the heating and/or cooling elements may be associated (or thermally coupled) with the reservoir in such dispenser (for example, reservoirs 335, 435, 635, 805 (and/or 815), 1050, and 1150).

As described herein, the present invention provides a beverage cooler having a container for holding a liquid beverage, a spigot extending from the container for dispensing the liquid beverage therefrom, preferably a telescopically extendable boom attached to a side of the container, a solar panel adjustably attached to an end of the telescopically extendable boom so that the solar panel may be repositioned about the end of the telescopically extendable boom so as to point the solar panel in a direction toward a source of solar energy, and one or more active elements in thermal contact with the container and the liquid beverage therein and electrically connected to the solar panel. Thermoelectric elements powered by the solar panel may be used to cool or heat the liquid beverage within the container. The container may comprise a conventional cooler used for dispensing a liquid beverage or may comprise a removable top closeable over a space large enough to hold and fully enclose an inverted standard sized bottle, a base for maintaining the inverted standard sized bottle in an inverted position and mating surfaces for receiving the removable top, a collar having an aperture sized to receive a neck portion of the inverted standard sized bottle and disposed within the base for supporting the inverted standard sized bottle in the inverted position, and a reservoir attached to the collar for receiving the liquid from the inverted standard sized bottle. In various embodiments, a solar panel with telescopic and adjustment features is described that may be used as a power source for heating and/or cooling elements incorporated in the beverage dispenser. In other embodiments, the power source may comprise batteries or a motion (or mechanical-winding) mechanism.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

What is claimed is:

1. A beverage cooler having a container for holding a liquid beverage, a spigot extending from said container for dispensing said liquid beverage therefrom, a telescopically extendable boom attached to a side of said container, a solar panel adjustably attached to an end of said telescopically extendable boom such that said solar panel is repositionable about said end of said telescopically extendable boom to point said solar panel in a direction toward a source of solar energy, and one or more active elements in thermal contact with said container and said liquid beverage therein and electrically connected to said solar panel.

2. The beverage cooler of claim 1, wherein each of said active elements comprise a thermoelectric element configured for cooling said container and said liquid therein.

3. The beverage cooler of claim 2, wherein said solar panel comprises a ring-shaped arrangement of one or more solar cells.

4. The beverage cooler of claim 2, wherein said container comprises:

a removable top made of a rigid material and closeable over a space large enough to hold and fully enclose an inverted standard sized bottle;

a base having a substantially flat bottom surface for maintaining said inverted standard sized bottle in an inverted position and mating surfaces for receiving said removable top;

a collar having an aperture sized to receive a neck portion of said inverted standard sized bottle and disposed within said base for supporting said inverted standard sized bottle in said inverted position; and a reservoir attached to said collar for receiving said liquid from said inverted standard sized bottle, whereby said neck portion of said inverted standard sized bottle extends downward through said aperture of said collar into said reservoir, wherein said spigot extends from said reservoir for dispensing said liquid from said reservoir.

5. The beverage cooler of claim 4, wherein said inverted standard sized bottle comprises an inverted three-gallon sized bottle or an inverted five-gallon sized bottle, said bottle of a type commonly used with commercial floor standing bottled water dispensers.

6. The beverage cooler of claim 4, wherein said removable top covers at least 50% of the height of said inverted standard sized bottle.

7. The beverage cooler of claim 4, wherein said removable top includes at least one latching mechanism for securably retaining said inverted standard sized bottle to said base thereby minimizing leakage of said liquid from said dispenser when said beverage cooler is moved from place to place.

8. The beverage cooler of claim 4, wherein said removable top includes insulation material for insulating said inverted standard sized bottle from temperature conditions external to said beverage cooler.

9. The beverage cooler of claim 4, wherein said removable top comprises an opaque material.

10. A beverage dispenser for gravitationally dispensing a liquid beverage, the beverage dispenser comprising:

a container capable of holding a liquid beverage;

a spigot extending from said container for dispensing said liquid beverage therefrom;

one or more solar cells disposed on a solar panel detachably mounted on a top surface of said beverage dispenser; and an extendable boom attached to said container and capable of telescopically extending outward from said top surface of said beverage dispenser, wherein said solar panel is separable from said top surface of said beverage dispenser and adjustably mounted to said extendable boom, wherein said solar panel is capable of being repositioned with respect to said extendable boom to point said solar panel toward a source of solar energy, wherein said container comprises:

a removable top made of a rigid material and closeable over a space large enough to hold and filly enclose an inverted standard sized bottle;

a base having a substantially flat bottom surface for maintaining said inverted standard sized bottle in an inverted position and mating surfaces for receiving said removable top;

a collar having an aperture sized to receive a neck portion of said inverted standard sized bottle and disposed within said base for supporting said inverted standard sized bottle in said inverted position; and a reservoir attached to said collar for receiving said liquid from said inverted standard sized bottle, whereby said neck portion of said inverted standard sized bottle extends downward through said aperture of said collar into said reservoir, wherein said spigot extends from said reservoir for dispensing said liquid from said reservoir, said beverage dispenser further comprising at least one active element in thermal contact with said reservoir and electrically connected to said one or more solar cells, said reservoir comprising a thermally conductive material and said active element capable of changing the temperature of said reservoir and said liquid therein, and wherein said active element comprises a thermoelectric element configured for heating said reservoir and said liquid therein.

* * * * *

UNITED STATES PATENT AND TRADEMARK OFFICE

CERTIFICATE OF CORRECTION

PATENT NO. : 7,182,222 B2
APPLICATION NO. : 11/339594
DATED : February 27, 2007
INVENTOR(S) : Robert W. Prabucki It is certified that error appears in the above-identified patent and that said Letters Patent is hereby corrected as shown below:

Column 4, Line 27 delete “p” after “liquid”
Column 4, Line 62 change “toobox” to --toolbox--
Column 8, Line 26 change “reservoir 625” to --reservoir 635--
Column 12, Line 28 change “miotion-” to --motion- --
Column 13, Line 33 change “forgoing” to --foregoing--
Column 13, Lines 35-36 change “equivalence” to --equivalents--
Column 14, Line 49 change “filly” to --fully--

Signed and Sealed this

Eighth Day of July, 2008

JON W. DUDAS
*Director of the United States Patent and Trademark Office*